US005419467A

United States Patent [19]

Maguire et al.

[11] Patent Number: 5,419,467

[45] Date of Patent: May 30, 1995

[54] TWO-PIECE POURING SPOUT WITH DOME-SHAPED NOZZLE

[75] Inventors: Paul R. Maguire, Los Angeles; John M. Lown, Huntington Beach, both of Calif.

[73] Assignee: FloTool International, Inc., Tustin, Calif.

[21] Appl. No.: 113,204

[22] Filed: Aug. 27, 1993

[51] Int. Cl.[6] ..... B65D 47/20

[52] U.S. Cl. ..... 222/548; 222/553

[58] Field of Search ..... 222/553, 548

[56] References Cited

U.S. PATENT DOCUMENTS

| | | | |
|---|---|---|---|
| 1,738,220 | 12/1929 | Amsden | 222/553 |
| 1,764,973 | 6/1930 | Ohmart | 222/553 |
| 1,996,493 | 4/1935 | Schumacher | 222/553 |
| 2,041,351 | 5/1936 | Jones | 222/553 |
| 2,156,654 | 5/1939 | Kleid | 222/548 |
| 2,591,231 | 4/1952 | Boadway | 222/521 |
| 2,717,727 | 3/1953 | Robb | 222/553 |
| 2,759,643 | 8/1956 | Dahlin | 222/521 |
| 2,778,547 | 1/1957 | Atterby | 222/553 |
| 2,791,358 | 5/1957 | Gaertner | 222/553 |
| 2,944,708 | 7/1960 | Smeaton | 222/553 |
| 3,029,003 | 4/1962 | Gronemeyer | 222/548 |
| 3,123,259 | 3/1964 | Musel et al. | 222/521 |
| 3,305,127 | 2/1967 | Baranne | 220/39 |
| 4,361,255 | 11/1982 | Sailo et al. | 222/383 |
| 4,461,454 | 7/1984 | Vadnais | 222/521 |
| 4,979,655 | 12/1990 | Gallucci | 222/548 |
| 5,000,360 | 3/1991 | Lown et al. | 222/521 |
| 5,135,140 | 8/1992 | Maguire | 222/521 |

FOREIGN PATENT DOCUMENTS

| | | | |
|---|---|---|---|
| 238345 | 1/1960 | Australia | 222/553 |
| 662616 | 12/1951 | United Kingdom | 222/553 |

*Primary Examiner*—Andres Kashnikow
*Assistant Examiner*—Kenneth Bomberg
*Attorney, Agent, or Firm*—Harold L. Jackson

[57] ABSTRACT

A two part spout assembly, where both tubular body and spout member are hollow and cylindrical. The inner tubular body is extended to a stopper dome-shaped nozzle with a large semi-elliptic opening. The spout member has a stopper coupling sleeve conforming to the stopper dome-shaped nozzle, with the semi-elliptic opening of the same size, protruding inwardly and formed integrally with the spout member wall. By rotatably sliding the spout member until it reaches the "off" mark the nozzle is placed to a position to complement the spout member to seal the container against the outflow of its contents through the spout. When rotated by 180 degrees, the two domes and openings are fully aligned and the spout is fully opened.

22 Claims, 4 Drawing Sheets

TWO-PIECE POURING SPOUT WITH DOME-SHAPED NOZZLE

BACKGROUND OF THE INVENTION

1. Field of the Invention

This invention relates generally to pouring spouts which can be selectively opened and closed when attached to dispense liquids or other materials from containers or bottles.

2. Description of Prior Art

There is a need for reliable and simple pouring spouts which are inexpensive to make and easy to use with one hand while allowing control in dispensing the amount of fluid needed and reliable storage of the opened container when not in use.

Typical conventional spout structures provide closure via screw caps threadedly attached to the opening on the spout that can be easily lost during a filling operation. Other types of spouts are funnel shaped and it is impossible to control the amount of fluid being dispensed. Some spouts such as those used with faucets and funnels use valves which can selectively interrupt the flow through the spout. Many spouts have small openings and are inapplicable for solid materials.

Stopper type mechanisms designed in later years, like the one illustrated in U.S. Pat. Nos. 3,305,127; 2,759,643 and 2,591,231 issued to Baranne, Dahlin and Broadway, respectively, are complex and expensive to manufacture by standard plastic molding techniques.

The patents listed below were uncovered in a preliminary patentability search. The patents are listed in descending numerical order and no other significance is intended.

U.S. Pat. No. 5,135,140; Sealable and Dispensing Pouring Spout; Paul Maguire. This patent describes a complicated three-piece spout using cam arrangement means.

U.S. Pat. No. 5,000,360; Pouring Spout Which Can Be Selectively Opened and Closed; John Lown. This patent is directed to a three-piece selectively opened and closed spout.

U.S. Pat. No. 4,979,655; Pouring Fitment; Daniel Gallucci. This patent is directed to a two-piece assembly with conical fitting end for openings of varying dimensions and with closed top with small openings for dispensing of fluids.

U.S. Pat. No. 4,461,454; Caulking Tube Valve; Kenneth Vadnais. This patents describes a two-piece valve insertable in caulking guns that has a rotatable domed tip for sealing the valve closure.

U.S. Pat. No. 2,759,643; Container Closure; Olof Dahlin. This patent is directed to a closure for containers for powders, pastes and liquids having a nozzle insertable inside the tube with a head pressing into the opening channel for closure.

U.S. Pat. No. 3,123,259; Improved Dispensing Closure; J. T. Baker Chemical Company. This patent is directed to a closure consisting of a rotatable outer sleeve and a disk-like inner member.

There is a need for a valve controlled spout suitable for use in dispensing materials such as vehicle oil which is inexpensive to manufacture, simple and durable.

SUMMARY OF THE INVENTION

This invention is directed to a two-piece spout which permits selective opening and closing of a container and is simple in design, easy and inexpensive to manufacture and durable in construction.

It is, therefore, an object of the invention to provide a spout that can be manufactured by low cost plastic injection molding techniques, requiring production of only two pieces.

It is another advantage flowing from this invention that the user need employ only a thumb and finger of one hand to dispense the contents of the container.

It is further object of the invention to provide an improved spout adapted to preserve and prevent spillage of unused oil from an opened oil container.

It is still a further object to provide an improved pouring spout which may be attached to an opened oil container, thereby allowing the desired quantities of unused oil to be dispensed as needed into a small internal combustion engine such as is employed in a lawn mower or the like.

It is further object of this invention to provide a spout designed to be attached to many different types of containers dispensing liquids, as well as pastes and powders.

What is claimed is a two piece pouring spout comprising an inner tubular body member and an outer cylindrical closure member having an opening through which liquids, pastes and powders may be dispensed from a container.

The inner tubular body member has at its lower end a cylindrical section with screw threads in the internal walls thereof, adapted to fit screw threads on the outer neck of the container. The tubular body ends in a dome-shaped wall or surface having a semi-elliptical opening (or section of an ellipsoid) through which container materials may pass when the pouring spout is in the open position.

The outer closure member is slidably and rotatably mounted over the tubular body and has a cylindrical body with a circular opening at the top and a dome-shaped stopper wall or surface with a semi-elliptical opening therein. The semi-elliptical opening of the outer closure member substantially coincides with the semi-elliptical opening in the inner member when the spout is in the open position. When the closure member is rotated to the closed position the dome-shaped surface of the outer closure member covers and seals the elliptical opening in the inner tubular body. The dome-shaped surface of the tubular body and the dome-shaped surface of the closure member coaxially converge at a common longitudinal axis of the spout to restrict relative axial movement and are sized for an interference fit to complementary and effectively close said opening when their respective semi-elliptical openings are located on opposite sides.

The features of the present invention may best be understood in reference to the following descriptions taken in conjunction with the accompanying drawings.

DESCRIPTION OF THE PREFERRED EMBODIMENT

Figure 1:
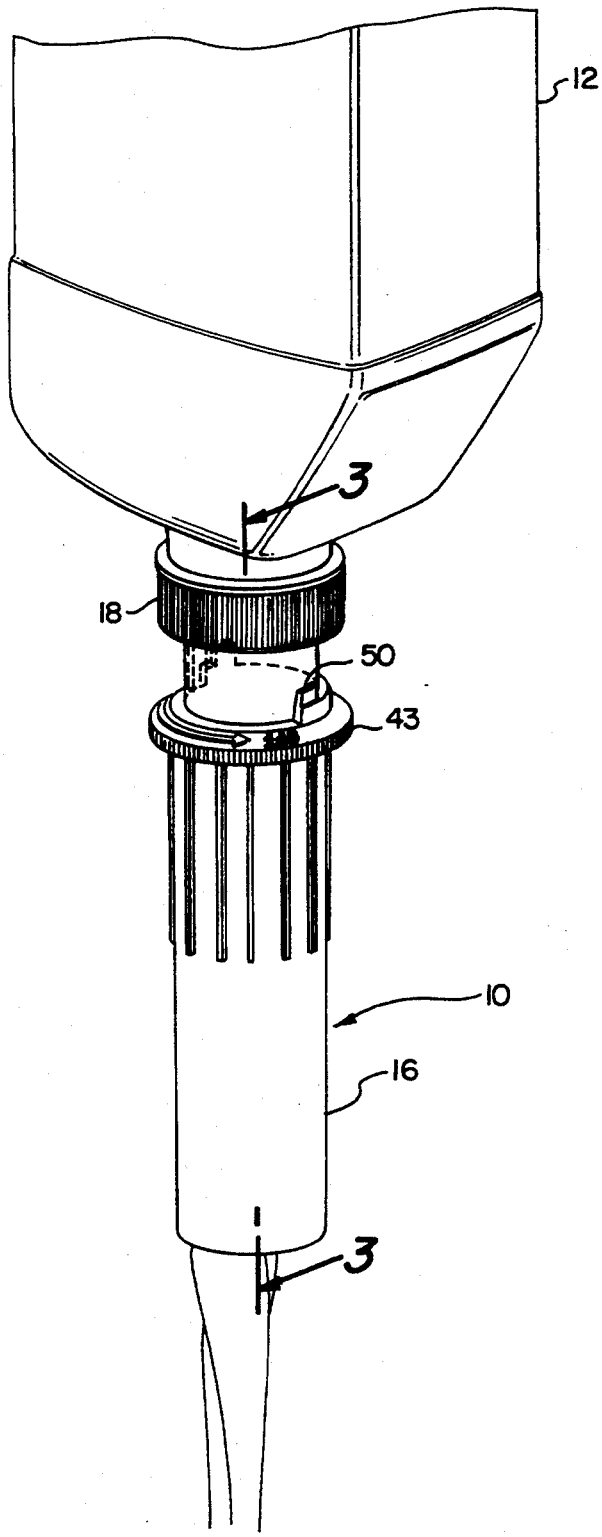
FIG. 1 is a perspective view showing the sealable and dispensing pouring spout in an inverted position and mounted on a container in accordance with the principles of the invention.

Referring now to the drawings, wherein like or similar parts are designated by the same numerals throughout the various figures, a sealable and dispensing pouring spout 10, coupled to a container 12, is illustrated in FIG. 1. The spout comprises a two part assembly which preferably is manufactured from a material which is resilient, resistant and compatible with the contents of the container. A synthetic plastic material such as polypropylene is preferable and the two parts employed in the design may be readily made by inexpensive and conventional plastic injection molding techniques.

Figure 2:
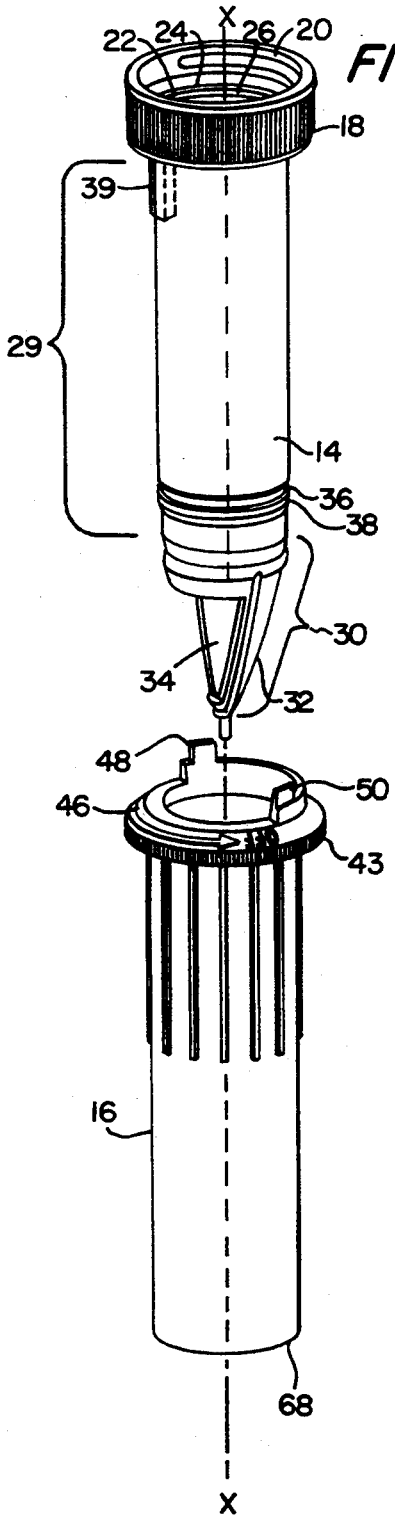
FIG. 2 is a perspective view of the two spout components separated.
Figure 3:
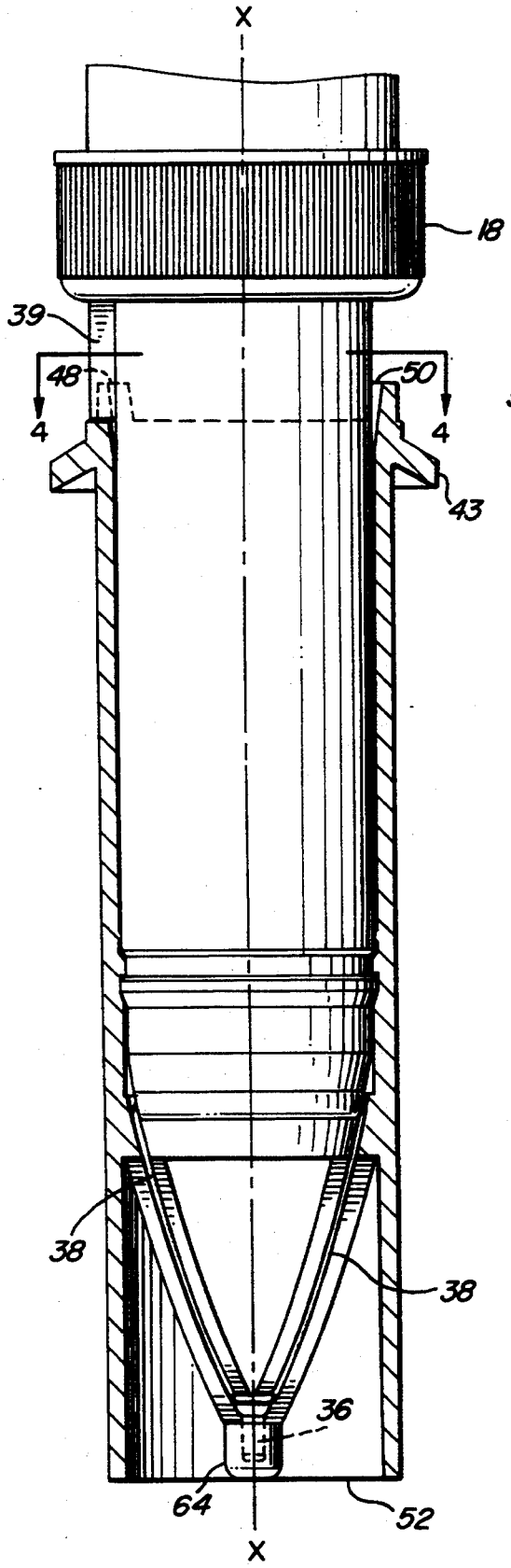
FIG. 3 is a fully assembled, partially cross-sectional view taken on line 3—3 of FIG. 1 with the spout in the open position.
Figure 7:
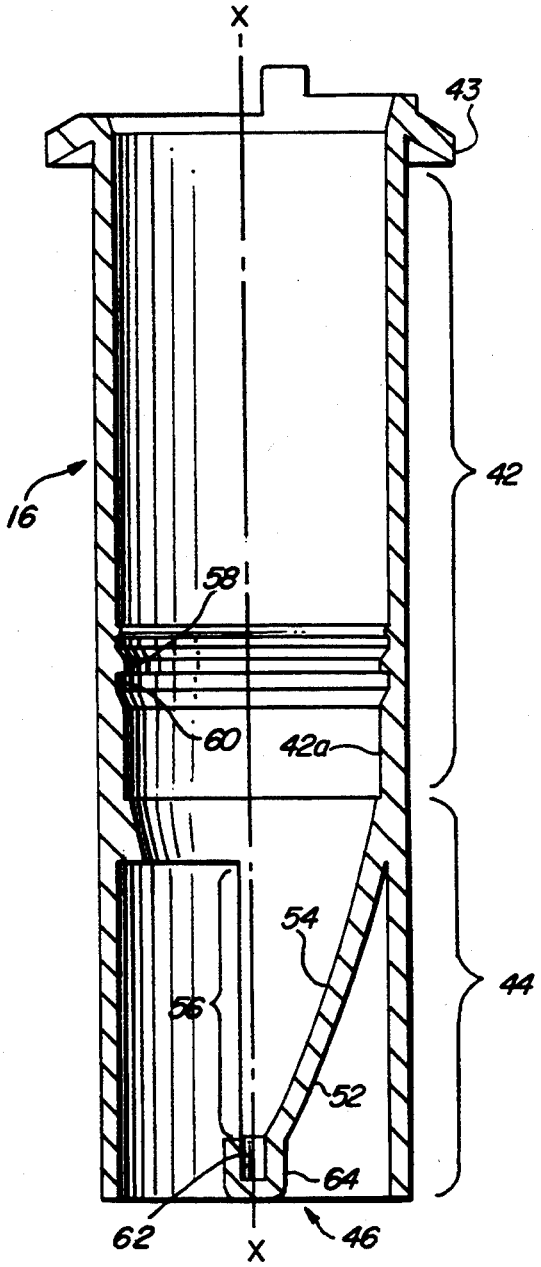
FIG. 7 is a cross-sectional view of the outer closure member employed in the pouring spout of FIG. 1.
Figure 8:
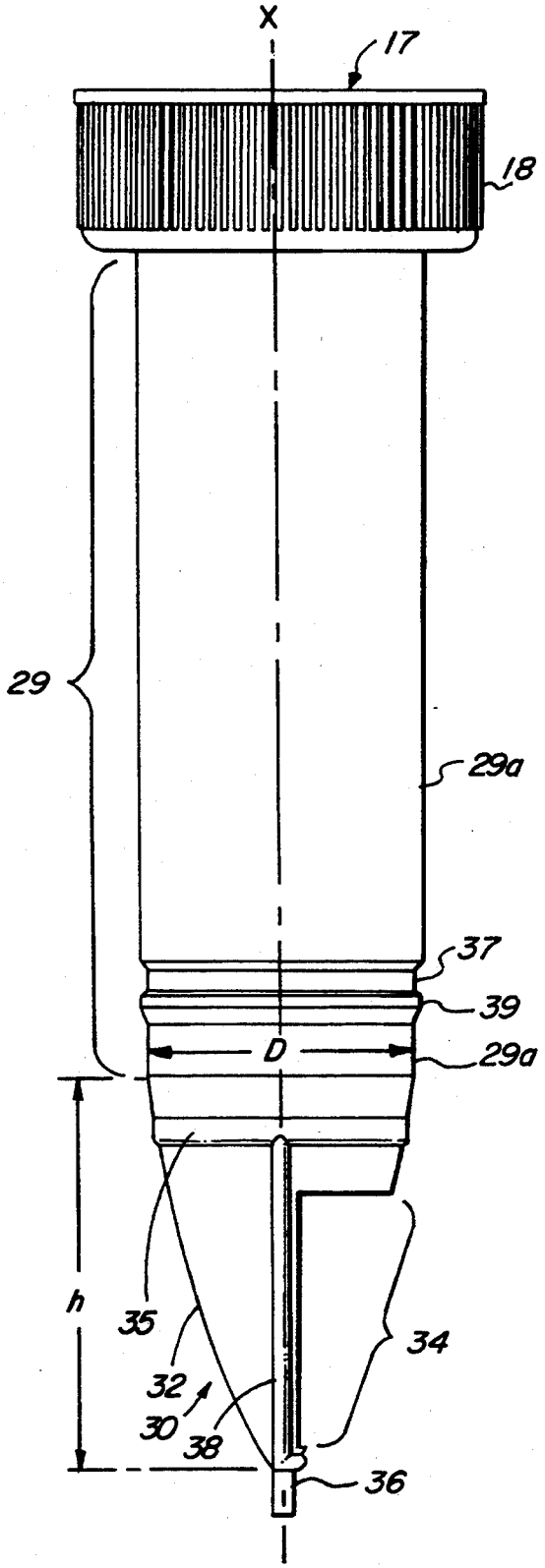
FIG. 8 is a cross-sectional view of the inner tubular body member employed in the pouring spout of FIG. 1.

As shown in FIG. 2, the two parts of the spout consist of an inner tubular body member 14 (illustrated separately in FIG. 8), and an outer closure member 16 (also of tubular form and illustrated in FIG. 7). The spout is particularly designed to attach to and be transportable with an oil container to enable a user to fill an automobile, aircraft or other machinery engine. The outer closure member 16 is partially ribbed or fluted to provide a finger grip for turning the outer member relative to the inner tubular body 14 for opening and closing the spout.

The inner tubular body member 14 terminates at its coupling or lower end 17 (with the body member inverted from the position shown in FIG. 2) in a cylindrical closure portion or annular cap 18. The cap 18 has female threads 20 adapted to cooperate with the external threads of the neck of a container in which liquids (e.g., oil), pastes, or powders are packaged. The cap 18 may be knurled on the outer surface, as shown in FIG. 2, to aid a user in installing the spout on a container. An annular lip or seal 22 is formed above the threaded section and inside the cap 18. The seal 22 preferably contains a pair of annular beads 24, 26, joined together by depression or groove 28 to prevent fluid leakage from the cap 18 by the pressure engagement between the top of the container neck and the bead arrangement.

An elongated intermediate cylindrical section 29 extends from the cap 18 to a dome-shaped wall section 30. The wall section 30 defines a dome-shaped outer surface 32 and an opening 34 in the form of a section of an ellipsoid (i.e., semi-elliptical) at the discharge or upper end of the tubular body 14. See FIG. 8. The dome-shaped section 30 includes at its lower end an annular sealing rib 35. A cylindrical stub shaft 36 aligned with the longitudinal axis x—x of the spout is carried at the upper end of the wall section 30. The shaft 36 is inserted into a corresponding bore (to be described) in the outer closure member. A pair of outwardly projecting sealing ribs 38 form the longitudinal edges of the semi-elliptical opening 34. A radially outwardly extending shoulder 39 is molded integrally with the tubular body 14 (adjacent the cap 18) for engaging on/off stop tabs on the outer closure member, to be described. The dome-shaped wall 30 preferably has a height h with the range of about 1 to 1.75 times its base diameter d of the cylindrical section 29 and most preferably about a height to diameter ratio of about 0.5.

The intermediate cylindrical section 29 includes an annular sealing groove 37 and an annular sealing rib 41 on the upper portion thereof for mating with corresponding elements (to be described) on the outer closure member to inhibit the flow of material from the container along the outer surface 29a of the cylindrical section 29.

Figure 4:
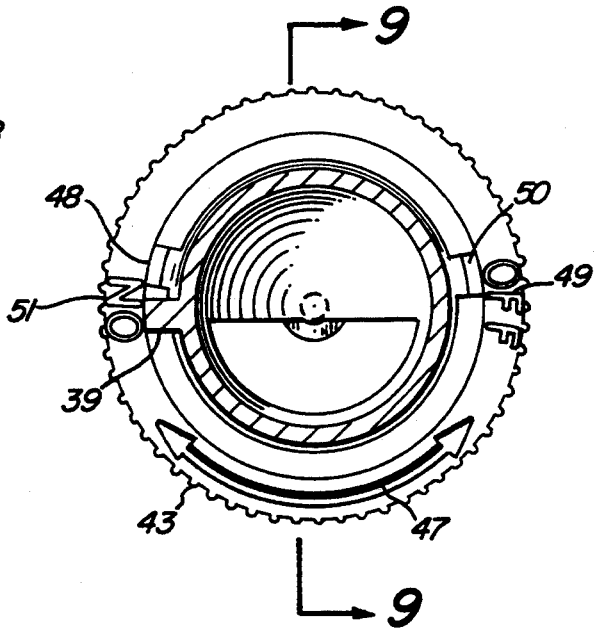
FIG. 4 is a sectional view taken on line 4—4 of FIG. 3.
Figure 5:
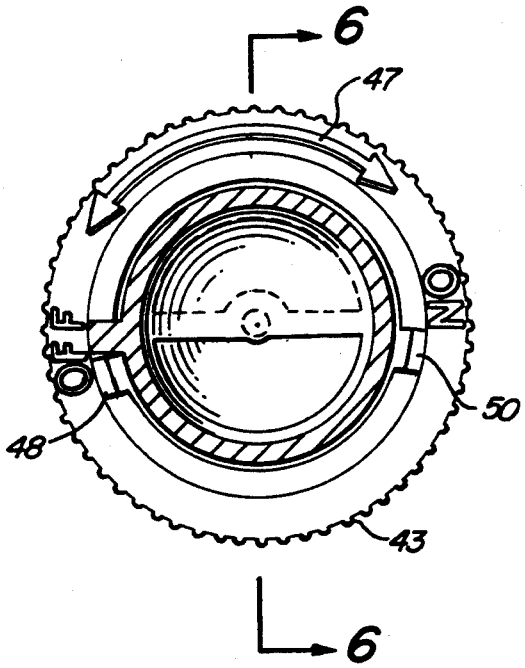
FIG. 5 is a sectional view taken on line 4—4 of FIG. 3 with the spout in its closed position.
Figure 6:
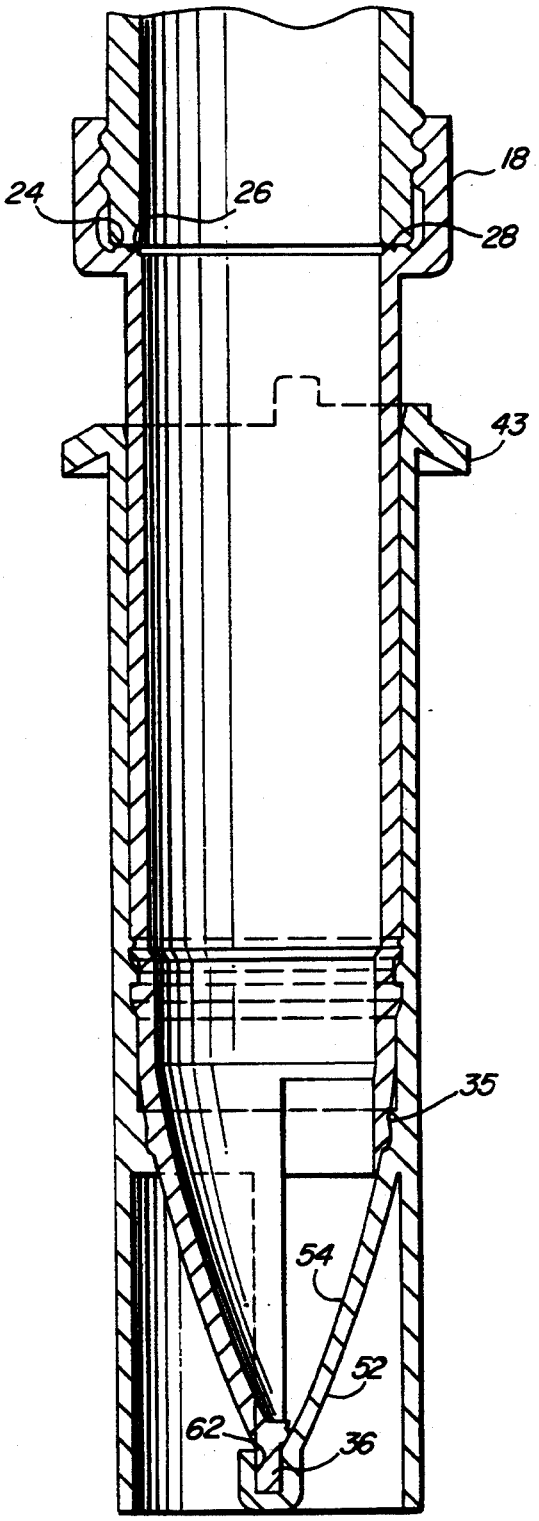
FIG. 6 is a fully assembled, cross-sectional view taken on line 6—6 of FIG. 5 with the spout closed.

The outer closure member 16 has an elongated lower cylindrical section 42 which terminates at the bottom in a knurled, ring-shaped collar 43 and an upper cylindrical section 44 which terminates in a circular opening 46 through which the contents of the container 12 are discharged. A graduation line 47 with arrow heads at each end is embossed onto the bottom of the collar 43 between raised letter characters which spell the words "on" 51 and "off" 49 as is shown in FIGS. 2, 5, and 6. The on/off marks serve to indicate when the spout is rotated to its full flow position or to its shut-off position as illustrated. On/off stop tabs 48 and 50, respectively, extend longitudinally downwardly from the bottom of the closure member 16, below the collar 43, for engaging the shoulder 39 on the inner member 14. See FIGS. 4 and 5.

Figure 9:
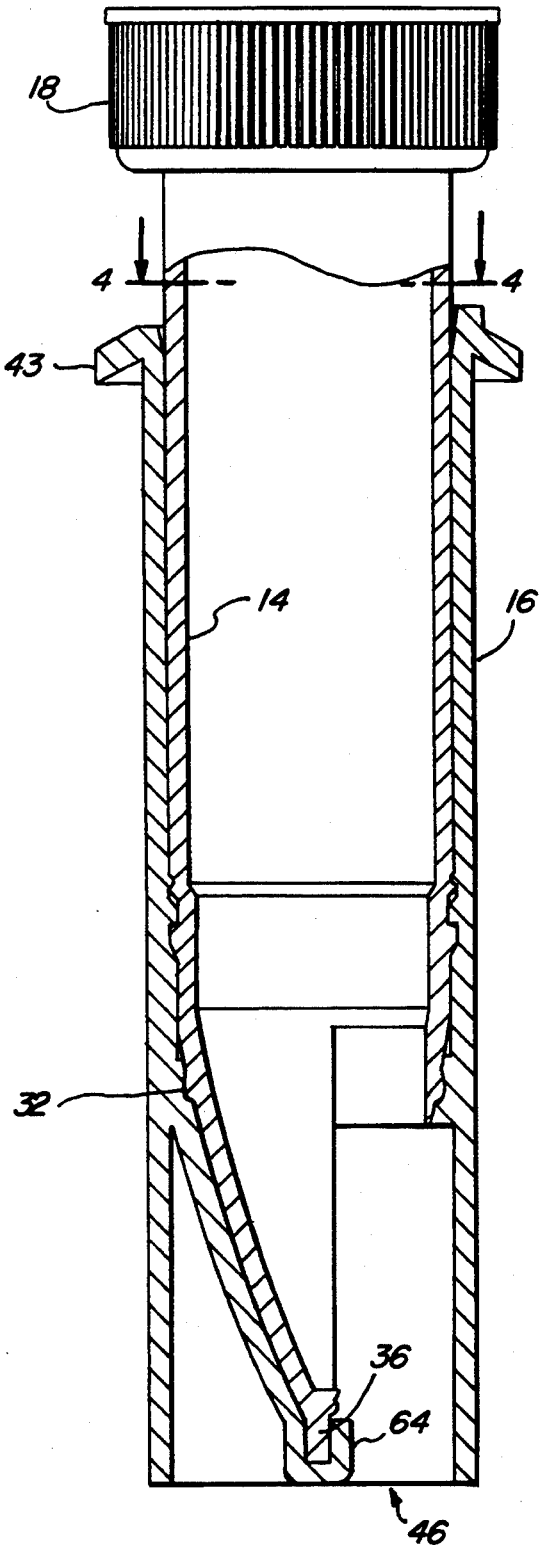
FIG. 9 is a fully assembled, cross-sectional view taken on line 9—9 of FIG. 4.

A dome-shaped wall (or stopper) section 52, extends from the discharge end 46 of the upper cylindrical section 44 (adjacent the longitudinal axis) downwardly and outwardly to the internal side wall **42*a* of the lower cylindrical section 42 as illustrated in FIG. 7. The inner surface 54 of the dome-shaped section 52 slidably and snugly engages the outer dome-shaped surface 32 (e.g., by an interference fit) and particularly the sealing ribs 35 and 38 of the inner tubular body member 14 to seal the elliptical opening 34 in the closed position of the spout. The dome-shaped wall section 52 of the closure member defines another semi-elliptical opening 56, corresponding in size and shape to a semi-elliptical opening 34 of the dome-shaped section 30 of the inner tubular body 14, as is shown on FIG. 9. The two elliptical openings 34 and 56 coincide when the spout is in the fully open position to provide a means of passage for the liquid or other materials within the container 12**.

The closure member 16 includes on its inner surface an annular sealing rib and groove 58 and 60, respectively, which mate with the corresponding sealing groove 37 and rib 41 on the inner body member 14. The closure member 16 further includes a bore 62 formed in a skirt 64 at the top of the dome-shaped section 52 for receiving the shaft 36 of the inner body member 14.

The opening 56 in the outer wall section 52 and the opening 34 in the inner wall section 30 are sometimes referred to hereinafter as the first and second openings, respectively. As will be apparent from the foregoing description of the spout, rotation of the outer closure member 16 until the tab 50 presses against the shoulder 39 completely closes the elliptical opening 34 of the inner member and prevents the discharge of material from the container. To open the spout for pouring, the outer closure member 16 is turned until tab 50 is removed from the shoulder 39 to a partial or fully open position. On tipping the container 12, liquid (or other) contents flow through the opening between the dome-shaped sections 30 and 52 into the space above and thence out through the spout discharge end opening 46.

While the particular configuration shown and described herein is directed to a particular embodiment, it is understood that those skilled in art may conceive modifications and/or variations to the specific embodiments herein. As an example, the dome-shaped section of the inner member may be provided with a bore which receives a shaft protruding downwardly from the upper end of the dome-shaped section on the outer member. Such modifications and/or variations would fall within the purview of this description and are intended to be included herein. It is understood that the description herein is intended to be illustrative only and is not intended to be limitative.

What is claimed is:

1. A two-piece pouring spout arrangement having a closable opening through which liquids, pastes and powders may be selectively dispensed from a container, comprising:

an outer tubular body member having two ends, an elongated intermediate tubular section extending from one end and a tapered dome-shaped stopper section extending between the intermediate tubular section and the other end, the dome-shaped stopper section having an inner dome-shaped surface with a first opening therein;

the outer tubular body member having a cylindrical shroud section extending axially over the dome-shaped stopper section which shroud section terminates in a circular opening;

an inner tubular body member having two ends, a coupling means at one end for attaching the pouring spout to the container, a tapered dome-shaped wall section at the other end and an elongated intermediate tubular section extending between the coupling means and the tapered dome-shaped wall section, the tapered wall section having an outer dome-shaped surface with a second opening therein; and the outer tubular body member being slideably and rotatably mounted over the inner tubular body member, the dome-shaped inner surface and dome-shaped outer surface being adjacently arranged such that the outer tubular body member may be rotated to align the respective first and second openings into an open position and rotated to close and seal the second opening in the inner tubular body member when the stopper section is rotated to a closed position.

2. The spout of claim 1 wherein one of the dome-shaped sections terminates into an integral axially aligned protruding stud and the other dome-shaped wall section terminates into an integral axially aligned skirt defining a bore for receiving the stud.

3. The spout of claim 2 wherein the dome-shaped wall-section of the inner tubular body member terminates in the stud.

4. The spout of claim 1 wherein the elongated intermediate tubular sections of the inner and outer tubular body members are provided with cooperating integral annular sealing ridges and grooves to prevent material from passing between the members from the opening in the dome-shaped wall section of the inner tubular body member.

5. The spout of claim 4 wherein one of the dome-shaped sections of one of the inner and outer tubular members has sealing ribs which surround the opening therein for sealing against the dome-shaped surface of the other member when the outer member is rotated to the closed position.

6. The spout of claim 5 wherein the sealing ribs are positioned on the outer dome-shaped surface of the inner tubular body member.

7. The spout of claim 1 wherein the inner tubular body member has an outwardly projecting shoulder and the outer tubular member has a pair of spaced apart stop tabs on said one end thereof, the shoulder being arranged to engage one of the stop tabs when the members are rotated relative to each other to the closed position and to engage the other tab when the members are rotated to the fully open position.

8. The spout of claim 1 wherein the inner and outer tubular body members have cooperative closure means having at least one annular projecting ridge and one groove on each tubular body member and disposed for preventing material from flowing between the members.

9. The spout of claim 1 wherein the ratio r of the height of the dome-shaped wall section of the inner tubular body member to the diameter of the elongated tubular section of the inner tubular body member is within the range of about 0.5 to 1.75.

10. The spout of claim 9 wherein r is about 1.5.

11. A two-piece pouring spout arrangement having a closeable opening through which liquids, pastes and powders may be selectively dispensed from a container, comprising:

an outer tubular body member having two ends, an elongated intermediate tubular section extending from one end and a dome-shaped outer wall section extending between the intermediate tubular section and the other end; the outer dome-shaped wall section having an inner dome-shaped surface with a first opening therein, the outer tubular body member having a cylindrical shroud section extending axially over the outer dome-shaped wall section which shroud section terminates in a circular opening;

an inner tubular body member having two ends, an elongated intermediate tubular section extending from one end and a tapered, a dome-shaped inner wall section extending between the intermediate tubular section and the other end, the tapered dome-shaped inner wall section having an outer dome-shaped surface with a second opening therein, and the outer tubular body member being slideably and rotatably mounted over the inner tubular body member, the inner dome-shaped surface and dome-shaped outer surface being adjacently arranged such that the outer tubular body member may be rotated to align the respective first and second openings into an open position and rotated to close and seal the second opening in the inner tubular body member when the outer wall section is rotated to a closed position.

12. The spout of claim 11 wherein one of the dome-shaped wall sections terminates into an axially protruding stud and the other dome-shaped wall section terminates into an axially aligned skirt defining a bore for receiving the stud.

13. The spout of claim 12 wherein the dome-shaped wall of the inner tubular body member terminates in the stud.

14. The spout of claim 11 wherein the elongated intermediate cylindrical section of the inner and outer tubular members are provided with cooperating annular sealing ridges and grooves to prevent material from passing between the members from the discharge opening in the dome-shaped wall section of the inner tubular body member.

15. The spout of claim 14 wherein the dome-shaped walls of one of the inner and outer tubular body members has sealing ribs which surround the opening therein for sealing against the dome-shaped wall of the other member when the outer member is rotated to the closed position.

16. The spout of claim 15 wherein the sealing ribs are positioned on the outer dome-shaped surface of the inner tubular member.

17. The spout of claim 11 wherein the inner tubular body member has an outwardly projecting shoulder and the outer tubular body member has a pair of spaced stop tabs on said one end thereof, the shoulder being arranged to engage one of the stop tabs when the members are rotated relative to each other to the closed position and to engage the other tab when the tubular body members are rotated to the fully open position.

18. The spout of claim 11 wherein the inner and outer tubular body members have cooperative closure means having at least one annular projecting ridge and one groove on each member and disposed for preventing material from flowing between the members.

19. A two-piece pouring spout arrangement having a closeable opening through which liquids, pastes and powders may be selectively dispensed from a container, comprising:

an outer tubular body member having two ends, an elongated intermediate cylindrical section extending from one end, and a dome-shaped outer wall section extending between the intermediate section and the other end, the outer wall section having an inner dome-shaped surface with a first opening therein and terminating into an axially aligned skirt defining a bore;

an inner tubular body member having two ends, an attachment section at one end thereof, a dome-shaped inner wall section at the other end thereof and, an elongated intermediate tubular section extending between the attachment section and the dome-shaped inner wall section, the dome-shaped inner wall section having an outer dome-shaped surface with a second opening therein, the dome-shaped inner wall section terminating into an axially aligned stud, and the outer tubular body slideably and rotatably mounted over the inner tubular body, the bore receiving the stud and the dome-shaped inner surface and dome-shaped outer surface being adjacently arranged such that the outer tubular body member may be rotated to align the respective first and second openings into an open position and rotated to close and seal the second opening in the inner tubular body member when the outer wall section is rotated to a closed position.

20. The spout of claim 19 wherein the outer tubular body member has a cylindrical shroud section extending axially over the outer dome-shaped wall section which shroud section terminates in a circular opening.

21. The spout of claim 20 wherein the elongated intermediate tubular section of the inner and outer tubular body members are provided with cooperating integral annular sealing ridges and grooves to prevent material from passing between the members from the opening in the dome-shaped inner wall section of the inner tubular body member.

22. The spout of claim 21 wherein one of the dome-shaped walls of one of the inner and outer tubular body members has sealing ribs which surround the opening therein for sealing against the dome-shaped wall of the other member when the outer member is rotated to the closed position.

* * * * *

UNITED STATES PATENT AND TRADEMARK OFFICE

CERTIFICATE OF CORRECTION

PATENT NO. : 5,419,467

DATED : May 30, 1995

INVENTOR(S) : Maguire et al

It is certified that error appears in the above-identified patent and that said Letters Patent is hereby corrected as shown below:

Column 5, line 53, delete "wall".

Column 5, line 56, "wall-section" should read --wall section--.

Signed and Sealed this

Twenty-second Day of August, 1995

Bruce Lehman

*Attest:*

BRUCE LEHMAN

*Attesting Officer*

*Commissioner of Patents and Trademarks*